United States Patent [19]

Kalyandurg

[11] Patent Number: 5,047,807

[45] Date of Patent: Sep. 10, 1991

[54] DEVELOPMENT APPARATUS HAVING A PLATE SCAVENGING DEVICE

[75] Inventor: Satyan R. Kalyandurg, Rochester, N.Y.

[73] Assignee: Eastman Kodak Company, Rochester, N.Y.

[21] Appl. No.: 597,135

[22] Filed: Oct. 15, 1990

[51] Int. Cl.[5] ..... G03G 21/00

[52] U.S. Cl. ..... 355/269; 118/652; 355/296

[58] Field of Search ..... 355/251, 253, 269, 296, 355/303, 305, 245, 252, 300; 118/657, 658, 652, 653, 656

[56] References Cited

U.S. PATENT DOCUMENTS

| | | | |
|---|---|---|---|
| 3,457,900 | 7/1969 | Drexler | 118/637 |
| 3,543,720 | 12/1970 | Drexler | 118/637 |
| 3,610,205 | 10/1971 | Rarey et al. | 118/653 X |
| 3,682,538 | 8/1972 | Cade et al. | 118/652 X |
| 3,967,892 | 7/1976 | Whited | 355/251 |
| 4,540,272 | 9/1985 | Abe et al. | 355/253 X |
| 4,613,554 | 9/1986 | Quang et al. | 118/657 |

*Primary Examiner*—A. T. Grimley
*Assistant Examiner*—William J. Royer
*Attorney, Agent, or Firm*—Tallam I. Nguti

[57] ABSTRACT

An internal scavenger device fits partially around the top portion of the development roller of a development apparatus. The device which consists of a single, stiff, electrically conductive and non-magnetic plate includes a development aperture, a wide carrier particle capture region adjacent the aperture, and +1300 VDC biasing source connected thereto.

7 Claims, 2 Drawing Sheets

DEVELOPMENT APPARATUS HAVING A PLATE SCAVENGING DEVICE

CROSS-REFERENCE TO A RELATED APPLICATION

This application is related to U.S. application Ser. No. 597,137 filed here on even date in the name of the same inventor, and entitled "MECHANISM FOR RESPONSIVELY SPACING A DEVELOPMENT ROLLER".

BACKGROUND OF THE INVENTION

1. Field of the Invention

The present invention relates to electrostatographic copiers and printers, and more particularly, to devices for removing or scavenging unwanted carrier particles from toner-developed images on the image-bearing member of such copiers and printers.

2. Background of the Invention

The process of producing or reproducing copies of images in an electrostatographic copier or printer involves moving an imaging member, in the form of a rigid drum or flexible web, past a series of process stations. As this occurs, the imaging member is first charged, and then imagewise exposed to form a latent electrostatic charge image thereon. The latent image is thereafter developed or made visible by moving it past a development station or apparatus where charged, pigmented toner particles, from development material which is held in a sump portion at the development station, are attracted to the latent image charges. The developed or toner image is subsequently transferred, at a transfer station, to a suitable receiver, such as a copy sheet of paper which is thereafter advanced through a fusing station. At the fusing station, the toner particles on the copy sheet, particularly those forming the desired image, are heated and fused. Meantime, any particles remaining on the imaging member are thereafter removed, at a cleaning station using a cleaning apparatus such as a fiber brush, prior to again reusing the imaging member as above to form and transfer images.

The development material being held in the sump portion at the development station may be single component, in that it consists entirely of toner particles. It also may be multiple component, for example two-component, which consists of an admixture of toner particles and carrier particles. In the latter case, the carrier particles are stirred together with the toner particles in order to triboelectrically charge both types of particles. The charged developer material, consisting of such charged particles, is then moved within the development station or apparatus so as to bring the toner particles into transfer proximity with the latent image on the image-bearing member during the development step of the electrostatographic process as described above.

During this development step, however, some of the carrier particles in the development material unfortunately are undesirably also transferred to the latent image on the image-bearing member. Such undesirably transferred carrier particles, referred to as DPU (developer pickup) particles, if not removed, will cause image defects such as black spots, image voids and halftones, when such particles (DPU) are transferred to the receiver for fusing.

In attempts to prevent such image defects, various conventional devices have been developed for removing such undesirable or unwanted carrier particles (DPU) from the image-bearing member prior to the toner image thereon being transferred to the receiver or copy sheet. For example, conventional roller and fixed magnet-type scavenging devices are disclosed in commonly assigned U.S. Pat. Nos. 3,457,900 issued July 29, 1969, and 3,543,720 issued Dec. 1, 1970, both in the names of R. A. Drexler et al. Each of these conventional roller-type scavenging devices includes a strong magnet positioned within a rotatable roller that is supported, and driven, supposedly spaced a small desired distance from a developed image on the image-bearing surface of the image-bearing member. As such, each such scavenging device includes rotatably supporting means, as well as driving means, thereby making it relatively more expensive, and more susceptible to moving component failure.

In addition, it has been found that such a roller-type scavenging device tends to sag about its middle when supported (at its ends) for such desired spacing across the width of the image-bearing surface. Such sagging detrimentally increases the spacing of the roller from the image-bearing surface towards the middle of the roller, and hence decreases its scavenging effectiveness thereat.

The scavenging effectiveness of such a roller-type scavenging device is also hampered because the roller can only scavenge or pick up DPU particles from a relatively narrow image area or band that corresponds to a footprint the roller would make on such image area when the image-bearing surface is tangential to the roller. Additionally, such a roller-type scavenging device undesirably accumulates some of the DPU particles scavenged from the image-bearing surface. Such accumulation occurs because of a tendency of some DPU particles to continue rotating around and around on, and with, the surface of the scavenging roller, rather than to desirably fall off. Such accumulation, for example, detrimentally effects the continued ability of the scavenging device to attract new DPU particles from the image-bearing surface, thereby resulting in poor quality copies.

SUMMARY OF THE INVENTION

It is an object of the present invention to provide an effective scavenging device, for use in an electrostatographic development apparatus, which includes relatively few and no moving components.

It is also an object of the present invention to provide a scavenging device that is constantly and precisely spaced from the image-bearing member.

It is a further object of the present invention to provide a scavenging device which does not accumulate carrier particles scavenged from the image-bearing member.

In accordance with the present invention, a scavenging device is provided for use in the development apparatus of an electrostatographic copier or printer which employs a multiple component developer material including charged toner and carrier particles. The scavenging device is for recapturing or scavenging unwanted charged carrier particles undesirably transferred to the image-bearing surface of such copier or printer during toner image development. The scavenging device comprises a first plate, having a first portion, and a second portion that include a development aperture and a flat and significantly wide particle pickup or recapturing surface area. The first plate is for stationary mounting between the image-bearing surface and the development roller of the development apparatus. The scavenging device also comprises a second plate that is connected to the first plate, and that is for guiding the movement of the recaptured particles away from the pickup area. The scavenging device further comprises connected electrical means for appropriately biasing the first and second plates to a polarity opposite to that of the charged carrier particles.

BRIEF DESCRIPTION OF THE DRAWINGS

In the detailed description of the invention presented below, reference is made to the accompanying drawings, in which.

DETAILED DESCRIPTION OF THE PREFERRED EMBODIMENT

Figure 1:
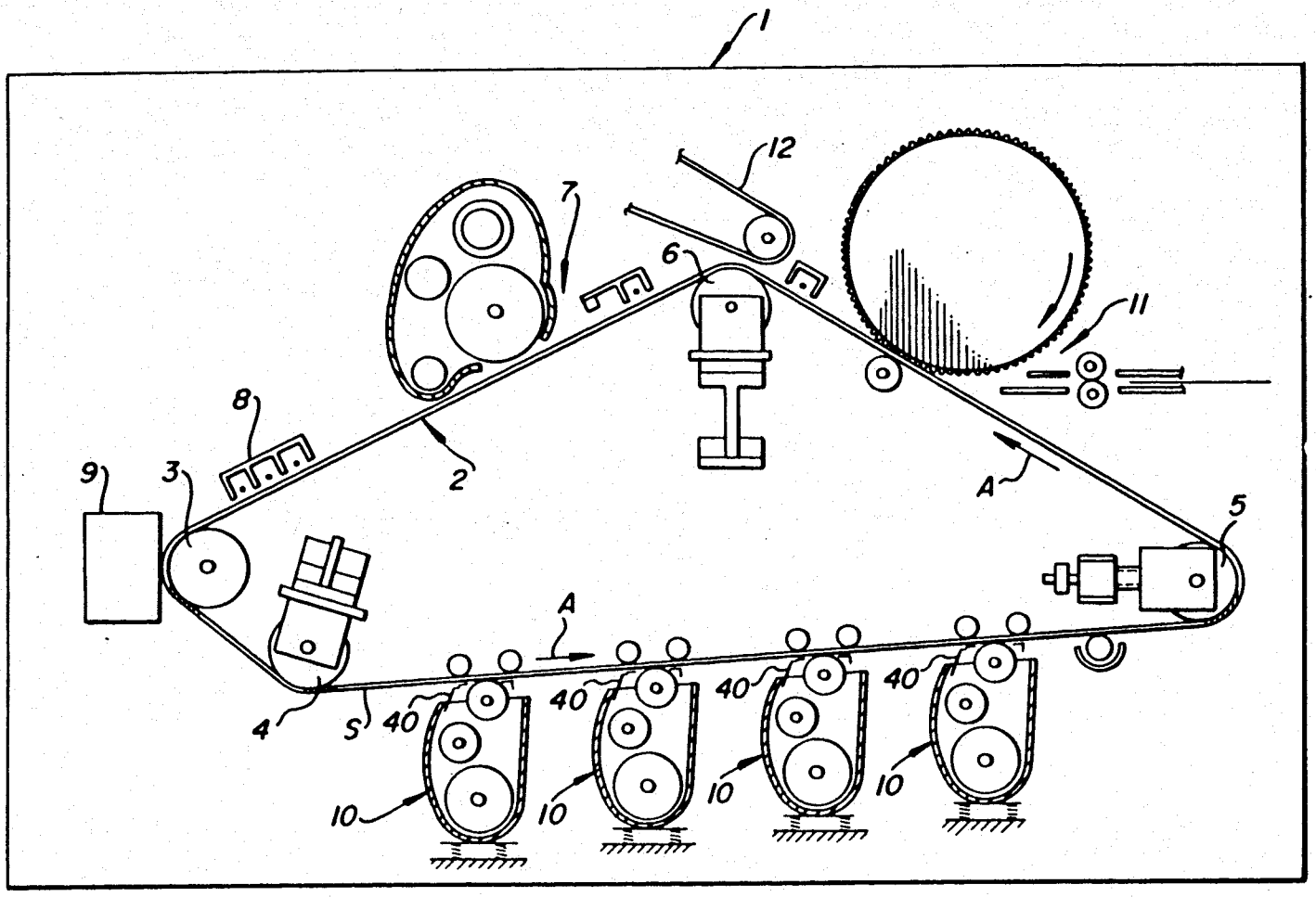
FIG. 1 is a schematic view of an electrostatographic reproduction apparatus such as a copier or printer including the development apparatus of the present invention.

Referring now to the accompanying drawings, FIG. 1 shows an electrostatographic reproduction apparatus such as a printer 1. The apparatus 1 can, of course, also be a copier/duplicator. As shown, the apparatus 1 includes an endless image-bearing member or film 2 that is trained for movement in the direction of the arrow A about a series of rollers 3, 4, 5 and 6, one of which is a driver roller.

As is well known, copies of original documents and/or prints of documents can be produced on the printer or copier 1 according to the electrostatographic process. For such process, moving portions of the image-bearing surface S of the image-bearing member 2, are each (a) cleaned at a cleaning station 7, (b) uniformly charged at a charging station 8, and (c) then imagewise exposed at an exposure station 9. The exposure station 9 is shown as an electronic printhead, but can equally consist of optical means.

Imagewise charge patterns or latent images formed at the exposure station 9 are next developed with toner particles at a development station or apparatus of the present invention designated generally as 10. A plurality of the development apparatus 10 is shown and, as such, can be used in producing multiple-color copies or prints. The toner developed image next moves to a transfer station 11 where it is transferred to a suitable receiver sheet. The receiver sheet is thereafter separated from the image-bearing member 2, and then transported to a fusing apparatus, not shown, by transport means shown as 12.

Figure 2:
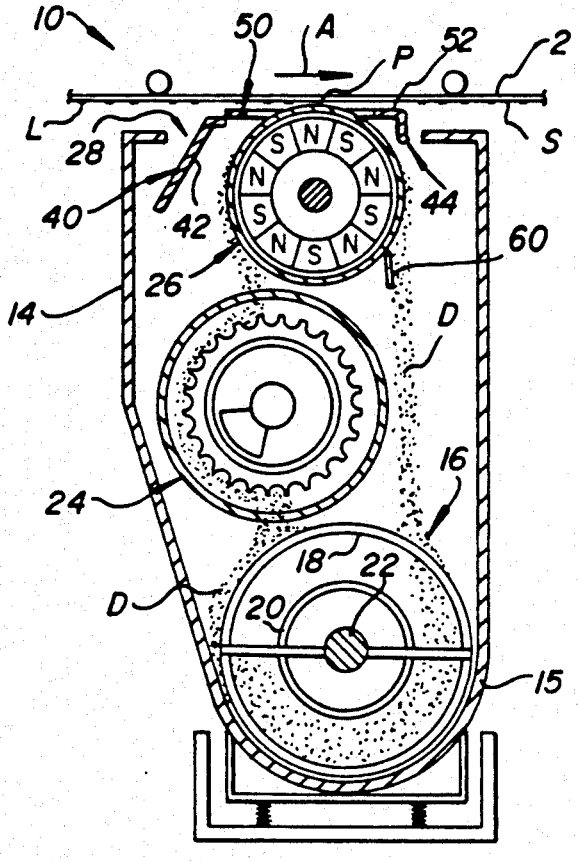
FIG. 2 is a schematic front end sectional view of the development apparatus of the present invention.

Referring now to FIG. 2, the development apparatus of the present invention 10 is shown. The apparatus 10 is a magnetic roller-type development apparatus, and is mountable in the electrostatographic copier or printer 1. As described above, the image-bearing member 2 of the printer 1 is movable in the direction, for example, of the arrow A relative to the development apparatus 10. As shown, the apparatus 10 is adapted to supply developer material D, containing marking or toner particles, for developing latent charge images L on the image-bearing surface S of the member 2. The latent images L may be composed, for example, of negative charges laid down at the charging station 8.

The development apparatus 10 comprises a housing 14 having a sump portion 15 for holding a supply of the developer material D. Developer material D consists, for example, of small hard magnetic carrier particles and of fusable marking or toner particles. The carrier and toner particles are chargeable triboelectrically by means of a rotatable ribbon blender 16 mounted in the sump portion 15. When the images L are negatively charged, the carrier particles, for example, will be charged negatively, and the toner particles positively.

The ribbon blender 16 may comprise an outer helical ribbon 18 and an inner helical ribbon 20. Both inner and outer ribbons are coiled concentrically about, and movable by a driven shaft 22. Movement of the ribbons 18 and 20 agitates the carrier and toner particles as well as moves them for delivery to a feed mechanism shown as 24. The feed mechanism 24 is located between the ribbon blender 16 and a magnetic brush or roller development means 26. Feed mechanism 24 as located, receives and feeds the charged carrier and toner particles to the magnetic development roller 26 which is located at the top of the housing 14 within an opening 28 therein.

Figure 3:
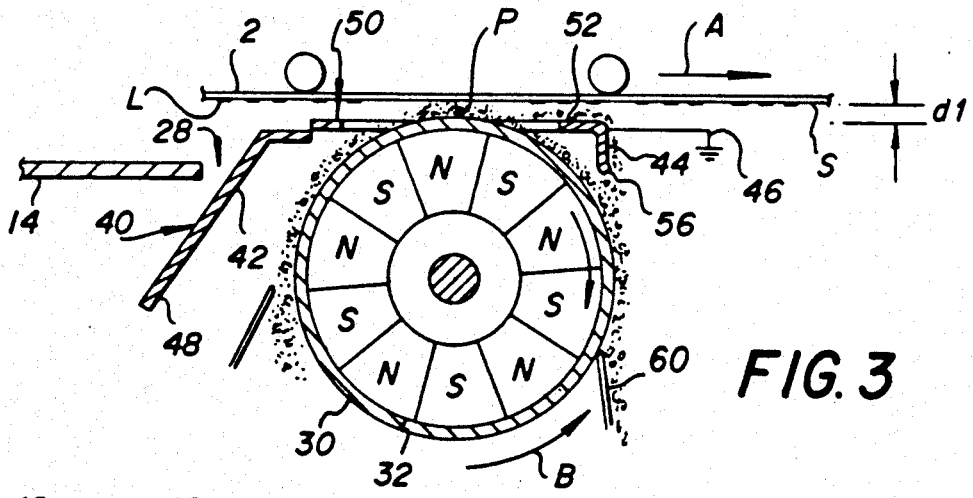
FIG. 3 is an enlarged schematic partly in section, of the magnetic development roller and scavenging device of the present invention.

The roller 26 may be of any suitable construction, and may include a non-magnetic shell 30 and a magnetic core 32 as shown in FIG. 3. The shell 30 may be rotatable in a counterclockwise direction as shown by the arrow B, about the core 32. The core 32 consists of a plurality of permanent magnets which are arranged in an alternating N-S pole pattern, and which can be rotated, for example, in a clockwise direction as indicated.

Referring to FIG. 2, a portion of the development roller 26, as mounted, projects through the opening 28 in the top of the housing 14 such that when the apparatus 10 is properly mounted in a copier or printer, the projecting portion will lie directly adjacent, or within a desired proximity to the latent images L. The proximity should be such that toner particles will be transferred to the negative-charge images L when developer material D consisting of negatively-charged carrier particles and positively-charged toner particles is transported on the magnetic roller 26 past such images L on the surface S. Such transfer of toner particles represents the development step of the electrostatographic process.

Such development occurs within a region or development nip indicated, for example, as P. The region P should lie centrally within the opening 28, FIGS. 2 and 3. During such development, the transfer of charged toner particles from the developer material D to the images L on the surface S as described above is desirable. Unfortunately, however, some of the carrier particles (referred to as DPU or developer pickup particles) undesirably also transfer to the surface S. This undesirable transfer of carrier particles is particularly serious when the carrier particles consist of small, hard and unfusable magnetic particles. In copiers and printers, DPU particles, in general, will result in finished image defects if left on the image-bearing surface and subsequently transferred at the transfer station 11 to a copy sheet or receiver.

In addition, in the case where such DPU particles consist of hard magnetic carrier particles, each of which is a small magnet with permanent N and S poles thereto, the impact of the changing poles of the rotating core 32 will be to cause each particle to repeatedly flip over and over again on the roller 26. Whereas such flipping over and over is desirable for continued agitation and charging of the developer material D on the roller 26, such flipping however also results in aeration and dusting of the toner particles. Toner dust or toner clouds result from such aeration and, if not properly controlled and kept within the housing 14, will ordinarily leak through portions of the opening 28 thereby resulting in undesirable contamination within the copier or printer 1.

In the present invention, in order to economically recapture DPU particles as well as effectively reduce the undesirable occurrence of toner cloud leakage as described above, an internal scavenging device designated generally as 40 is provided within the development apparatus 10. The primary function of the scavenging device 40 is to scavenge or recapture, from the image-bearing surface S (and within the development apparatus 10), unwanted carrier particles (DPU) which undesirably transferred thereto during toner image development. In addition, the device 40 also functions to effectively seal (against toner cloud leakage) the upstream side of the opening 28, relative to the development nip P and to the movement of the surface S.

Figure 4:
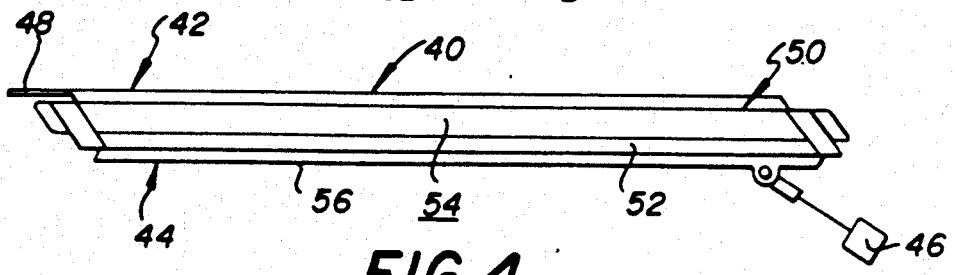
FIG. 4 is a perspective of the scavenging device of the present invention.

As illustrated in FIGS. 3 and 4, the scavenging device 40 comprises a first non-magnetic plate 42, a second non-magnetic plate 44, and electrical biasing means 46. The plates 42, 44 may, for example, be made of non-magnetic stainless steel. As shown, the first plate 42 includes a first portion 48 which is angled relative to the top of the housing 14, as well as to the opening 28 therein, and a second portion 50 which is parallel to the opening 28. The plate 42 is mounted by suitable means to the front and rear end walls (not shown) of the housing 14 such that the second portion 50 thereof will lie, spaced a small desired distance dl from the image-bearing surface S, as well as between such surface S and the magnetic development roller 26. The entire device 40 is lightweight, and because it is made of stainless steel, for example, it is structurally stiff and hence will ordinarily retain its precise spacing dl from the surface S, from the front to the rear of the apparatus 10. There is, therefore, no significant sagging, for example, about its midpoint as in the case of roller-type scavenging devices.

The second portion 50 of the first plate 42 includes a significantly large flat surface area 52, as well as a development aperture 54. The second portion 50 of the plate 42, as shown, fits within the opening 28, and the development aperture 54 therein thus lies within, and is smaller than the opening 28. The aperture 54 is substantially coincident with the width of the development nip P. As such, developer material D transported by the magnetic development roller 26, when moved through the opening 28, will also be moved through the aperture 54, and so will come into a toner particle-transfer relationship, within the nip P, with latent images L on the surface S. The flat surface area 52 of the second portion 50 of plate 42 is located so as to be downstream of the aperture 54, and hence also downstream of the development nip P. There, the area 52 is useful for exposing the surface S to a charged DPU particle recapture electrical field that is generated by the biasing source 46.

The electrical biasing source 46 is preferably a DC source and should have a polarity opposite to that of the charged carrier particles comprising the DPU particles to be recaptured. For example, in a development apparatus utilizing negatively-charged carrier particles, a positive potential should be applied for attracting and recapturing, from the surface S, unwanted negatively-charged DPU particles.

In the present invention, the flat surface (DPU particle recapture) area 52 is made to be substantially wider than a similarly intended tangential band or pickup area of a comparable roller-type scavenging member. The substantially wide, for example 2 mm, pickup area 52 of the plate portion 50, of course, results in a corresponding equally wide area on the surface S from which DPU particles can be picked up or recaptured due to the biasing effect of the area 52. Therefore, at any given speed for the surface S, a DPU particle on the surface S is exposed to the recapture influence of the area 52 for a significantly longer period of time than would be the case with a roller-type scavenging device. This results in a substantially increased DPU recapture efficiency for the plate device of the present invention when compared to the pick up of a comparable roller-type scavenging device.

As shown in FIG. 3, the scavenging device 40 is mounted, by suitable means, within the apparatus 10. The mounting is such that, when the apparatus 10 is properly installed in a copier or printer, the closest point of the electrically biased DPU pickup surface area 52 will be spaced the small distance dl in order to have a recapture influence on DPU particles on the surface S. The backside of the area 52, however, will have no similar pickup or recapture influence on charged carrier particles remaining on the magnetic roller 26. In other words, the portion 50 should be mounted so that the magnetic influence, of the roller 26 on the charged magnetic carrier particles on the roller 26 is stronger than the obviously competitive electrostatic influence of the plates 42 and 44 on the same particles. This, of course, prevents any significant carrier particle transfer from the roller 26 to any part or portion of the plates 42 and 44, and hence prevents any buildup of such particles, for example, on the backside of the surface 52.

In the present invention, in order for the pickup area 52 to have long-term effectiveness, means including the magnetic roller 26 are provided for removing therefrom, and for carrying away, the DPU particles recaptured by the area 52. Such removal means also include the second plate 44 which is connected at substantially a 90° angle to the horizontally orientated DPU pickup area 52 of the portion 50 (of the first plate 42). The second plate 44, connected as such, thus provides a sharp declining outer surface from the downstream edge of the surface 52, as shown, for guiding and directing DPU particles recaptured by the area 52, downwards and away from the area 52, as well as away from the image-bearing surface S. To facilitate the transfer of such particles from the surface area 52 onto the plate 44, the point of connection therebetween is radiused.

The entire second plate 44 therefore should be mounted close enough to the magnetic roller 26 so as to be within a significant influence of the magnetic field of its rotating N-S magnets. Such magnetic influence can be made stronger at the downstream free edge 56 of the plate 44 by forming a curve therein which positions the edge 56 closer to the magnetic roller 26. As such, the DPU particles, after transferring from the pickup area 52 onto the plate 44, are moved gravitationally and magnetically down to the free edge 56 where they are then magnetically pulled back onto the shell 30 of the magnetic development roller 26. Thereafter, a skive, for example, a mechanical skive 60 can be used to remove the particles from the shell 30 for return to the sump portion 15.

Referring again to FIGS. 2 and 3, toner cloud leakage, as discussed above, is prevented on the upstream side of the opening 28 by means of an angled portion 48 of the first plate 42. As shown, the angled portion 48 is positioned so as to form an effective toner dust and toner cloud shield or seal thereat by projecting the portion 48 into the apparatus 10, as well as against the upstream edge of the opening 28. Toner clouds, resulting from aeration of toner particles in the developer material D being agitated on the magnetic development roller 26, are thus effectively contained within the housing 14, and hence prevented from leaking and causing contamination elsewhere within the copier or printer 1.

As described, the scavenging device 40 of the present invention can be made from a single, thin and structurally stiff plate of non-magnetic stainless steel. When mounted properly within the development apparatus 10, the thin, structurally stiff non-magnetic stainless steel plate, particularly the flat DPU pickup area 52, will ordinarily retain its precise spacing dl from the image-bearing surface S of a host copier or printer without a risk of significant sagging, as typically occurs in the case of roller-type scavenging devices. In addition, the substantially wider DPU pickup surface area 52 when biased appropriately allows for longer DPU particle pickup time, and hence for greater and more effective DPU particle recapture from the surface S, than an equally biased roller-type scavenging device.

Furthermore, because the substantially vertical return plate 44 connected to the pickup surface area 52 ends with a sharp drop off edge which is curved back towards, and terminating near, the magnetic development roller 26, there is no tendency for recaptured DPU particles to walk or creep back up towards the image-bearing surface S. Advantageously, there is therefore, no accumulation of such particles on the area 52 following recapture.

The invention has been described in detail with particular reference to a presently preferred embodiment, but it will be understood that variations and modifications can be effected within the spirit and scope of the invention.

What is claimed is:

1. A scavenging device for use in a magnetic development apparatus of an electrostatographic copier or printer employing a multiple component developer material including charged toner and charged carrier particles, to recapture or scavenge charged magnetic carrier particles undesirably transferred to the image-bearing surface of such copier or printer during toner image development, the scavenging device comprising:

(a) a first non-magnetic plate for stationary mounting between the image-bearing surface and the magnetic development roller of the development apparatus, said first plate having a first portion and a second portion, and said second portion including a development aperture for allowing the charged toner particles to transfer from the development roller to the image-bearing surface, and a flat and substantially wide surface area for picking up or recapturing, unwanted charged carrier particles also transferring to the image-bearing surface;

(b) a second non-magnetic plate connected to said first plate for guiding the movement of recaptured particles away from said flat pickup surface area; and (c) means for electrically biasing said first and second plates to a polarity opposite to that of the charged carrier particles.

2. The scavenging device of claim 1 wherein said first and second plates are made from structurally stiff, non-magnetic stainless steel material.

3. The scavenging device of claim 1 wherein said second portion of said first plate is mounted so as to be substantially parallel to, and spaced a small distance from, the image-bearing surface of a host copier or printer of the development apparatus.

4. The scavenging device of claim 1 wherein the connection between said flat pickup surface area and said second plate is radiused.

5. The scavenging device of claim 1 wherein said first portion of said first plate is angled relative to the top of the development apparatus for forming a toner cloud shield therein.

6. The scavenging device of claim 1 wherein said second plate forms substantially a 90° angle with said flat pickup surface area of said first plate.

7. A magnetic development apparatus for use in an electrostatographic copier or printer employing multiple component developer material including charged carrier and toner particles, for developing latent charge images, the development apparatus comprising:

(a) a housing having a top portion including a development opening therein, and a bottom portion for holding and mixing developer material consisting of toner particles and small, hard magnetic carrier particles;

(b) a rotatable magnetic development roller, located within said development opening in said top portion of said housing, for developing the latent charge images with toner particles by moving the charged carrier and toner particles through said development opening into position for toner transfer to the latent charge images on an image-bearing member;

(c) means, located within said housing between said bottom portion and said magnetic development roller, for feeding charged developer material from said bottom portion to said magnetic development roller; and (d) a scavenging device for picking up or recapturing, from the image-bearing surface, unwanted carrier particles undesirably transferring from said magnetic development roller onto said image-bearing surface during such toner transfer to the latent images, the scavenging device comprising:

(i) a first non-magnetic plate for stationary mounting between the image-bearing surface and the magnetic development roller of the development apparatus, said first plate having a first portion and a second portion, and said second portion including a development aperture for allowing the toner particles to transfer from the development roller to the image-bearing surface, and a flat and substantially wide surface area for picking up or recapturing unwanted charged carrier particles also transferring to the image-bearing surface;

(ii) a second non-magnetic plate connected to said first plate for guiding the movement of recaptured particles away from said pickup surface area; and (iii) means for electrically biasing said first and second plates to a polarity opposite to that of the charged carrier particles.

* * * * *